US007958857B2

(12) United States Patent
Lichti et al.

(10) Patent No.: US 7,958,857 B2
(45) Date of Patent: Jun. 14, 2011

(54) CAM PHASER HELICAL BIAS SPRING HAVING A SQUARE END FOR RETENTION

(75) Inventors: Thomas H. Lichti, Victor, NY (US); Alan G. Strandburg, III, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 308 days.

(21) Appl. No.: 12/283,993

(22) Filed: Sep. 17, 2008

(65) Prior Publication Data

US 2010/0064996 A1 Mar. 18, 2010

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS

2002/0152977 A1* 10/2002 Eguchi et al. ..... 123/90.17
* cited by examiner

*Primary Examiner* — Zelalem Eshete
(74) *Attorney, Agent, or Firm* — Thomas N. Twomey

(57) ABSTRACT

A helical phaser bias spring including at least one linear region and an adjacent region having a radius of curvature less than that of the helix. A channel in the phaser receives the linear region of the spring and adjacent region to lock the spring to the phaser at either the rotor or the stator. Preferably, the spring includes two linear regions separated by a bend of about 90°. Additional linear regions are possible, separated by right and/or other angle bends. In a phaser rotor or stator, the geometric shape required to hold a spring end having a flat is easier to form with powdered metal tooling or diecasting than is a circular, radial, or axial shape for receiving a spring tang as in the prior art, the packaging volume required for the spring is smaller, and spring friction is lowered.

5 Claims, 6 Drawing Sheets

CAM PHASER HELICAL BIAS SPRING HAVING A SQUARE END FOR RETENTION

TECHNICAL FIELD

The present invention relates to phasers for varying the phase of combustion valve actuation with respect to a crankshaft in an internal combustion engine; more particularly, to such a phaser employing a spring for biasing the rotational position of a phaser rotor with respect to an associated phaser stator through at least a portion of the rotor range of authority; and most particularly, to such a phaser wherein a helical bias spring has at least one linear portion (also referred to herein as a "flat" portion) accompanied by a region of radius of curvature smaller than that of the helix at an end convolution thereof replacing a prior art radial or axial tang for engaging either the stator or the rotor.

BACKGROUND OF THE INVENTION

Camshaft phasers for varying the timing of combustion valves in an internal combustion engine transmit crankshaft torque to the engine camshaft, allowing varied timing of the camshaft relative to the crankshaft position.

It is known in some prior art phaser applications to employ one or more toroidal (also referred to herein as "helical") torsional bias springs within a phaser, grounded at opposite ends to the stator and rotor, respectively, to counterbalance a portion of the friction torque of the camshaft due to the valve train components (lifters, cam journals, cam driven accessories, etc.).

Such a bias spring is especially useful in exhaust phasing applications because the friction torque from the exhaust camshaft acts to retard the camshaft in opposition to the timing advance default position. The bias spring helps the exhaust phaser to return to its default (locked) position on engine shutdown and allows more balanced control of the phaser at intermediate positions.

Intake phasers also may include a bias spring having a somewhat lower spring constant to provide more balanced advancing and retarding rates while not preventing the phaser from reaching the retard default position.

In some prior art phasers, it is known to utilize a flat, spiral wound spring having a squared inner end, similar to the long-standing application of such springs in watches and clocks. In these applications, the squared inner end is grounded by being wrapped around a square sided mandrel. A shortcoming of this design is that, when a torsional force is applied to the spring, the squared inner end spreads open as the flats of the square ramp up the mating flat surfaces of the mandrel.

More typically however, prior art cam phaser bias springs are helically wound, utilizing spring ends (tangs) that are bent either radially outward or axially and engage a slot to ground the spring to the phaser component. A shortcoming of such prior art phasers using helical bias springs is that the shape required in the rotor and/or stator to anchor and restrain a radial or axial tang is known to cause difficulties in forming powdered metal components.

In addition, an axially bent end increases the axial length of the phaser, which is undesirable.

Further, in pulley phaser applications wherein the phaser must be sealed to prevent oil leakage to the exterior of the part, packaging is difficult because a cover plug is required for plugging the access hole for the central cam bolt. The space required for the cover plug consumes the space otherwise usable for an axial or radial spring end.

Still further, a radially-outward spring end requires adding seal plates or significant increases in radial packaging volume of the entire phaser.

What is needed in the art is an improved bias system for a camshaft phaser wherein a helical bias spring is mechanically anchored to the rotor end without resort to an axial or radial tang.

It is a principal object of the present invention to reduce the size, complexity, and manufacturing cost of a camshaft phaser.

SUMMARY OF THE INVENTION

Briefly described, a helical phaser bias spring in accordance with the present invention includes at least one linear region and an adjacent region having a radius of curvature less than that of the helix. A mating channel in the phaser receives the flat portion of the spring and adjacent region to lock the spring to the phaser at either the rotor or the stator. Preferably, the spring includes two flat regions separated by a bend of about 90°. Additional flat regions, for example three (defined herein as a "square" end to a spring) are possible, separated by right and/or other angle bends. In a phaser rotor or stator, the geometric shape required to hold a spring end having a flat is easier to form with powdered metal tooling or diecasting than is a circular, radial, or axial shape for receiving a spring tang as in the prior art, and the packaging volume required for the spring is smaller.

BRIEF DESCRIPTION OF THE DRAWINGS

The present invention will now be described, by way of example, with reference to the accompanying drawings, in which.

Corresponding reference characters indicate corresponding parts throughout the several views. The exemplifications set out herein illustrate currently preferred embodiments of the invention, and such exemplifications are not to be construed as limiting the scope of the invention in any manner.

DESCRIPTION OF THE PREFERRED EMBODIMENTS

Figure 1:
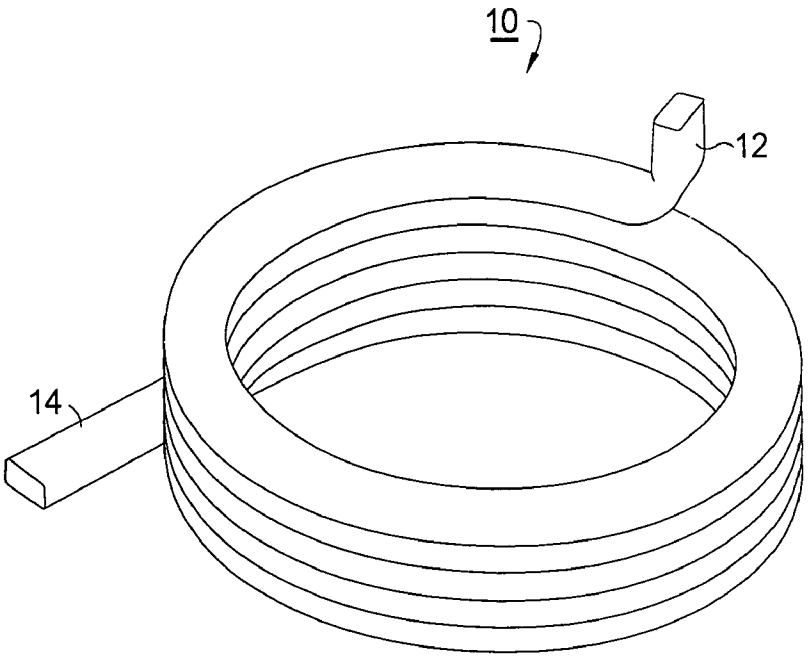
FIG. 1. (PRIOR ART)
FIG. 1 is an isometric view of a prior art helical phaser spring having an axial tang and a tangential tang.

Referring to FIG. 1, a first prior art helical bias spring 10 for a phaser (not shown) includes an axial tang 12 at a first end and a tangential tang 14 at a second end. The spring stock is rectangular in cross-section.

Figure 2:
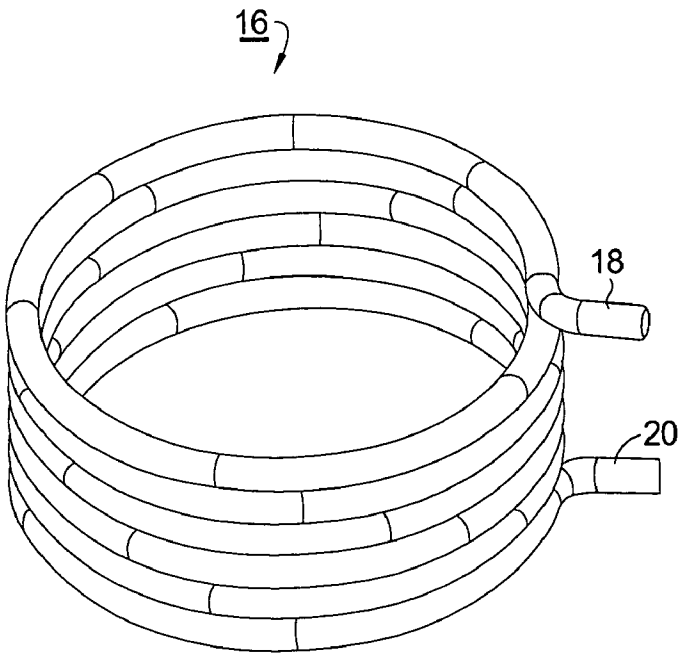
FIG. 2. (PRIOR ART)
FIG. 2 is an isometric view of a prior art helical phaser spring having first and second outward radial tangs.

Referring to FIG. 2, a second prior art helical bias spring 16 for a phaser includes a first radial tang 18 at a first end and a second radial tang 20 at a second end. The spring stock is round in cross-section.

Springs 10 and 16 are shown as examples of prior art springs used in prior art camshaft phasers. Note that prior art springs 10,16 employ tangs at both ends for being grounded to the stator and rotor of a phaser and further that the coils are circular and of unvarying radius.

Figure 4:
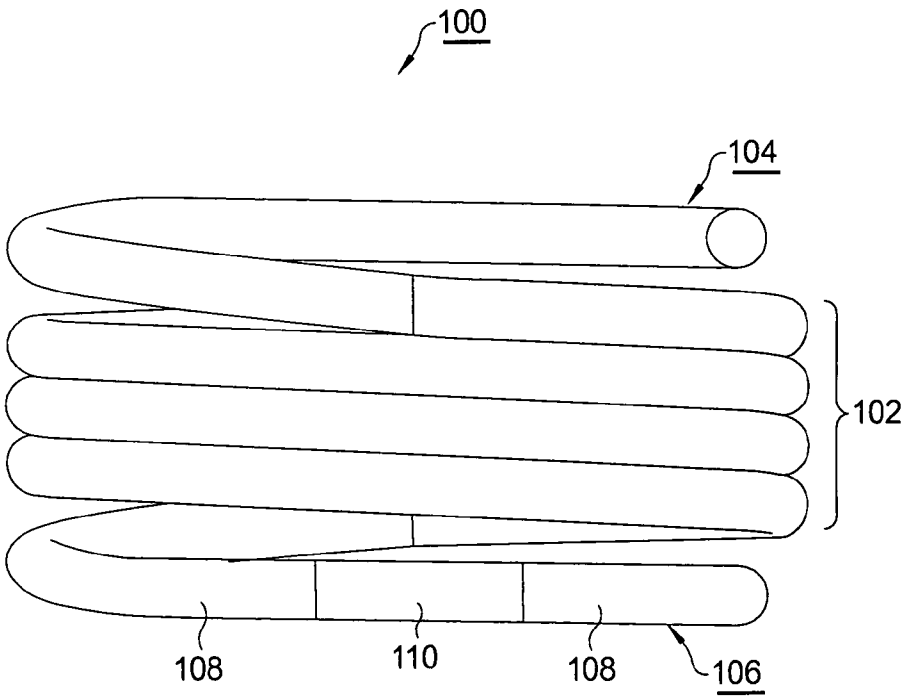
FIG. 4 is an elevational view of the helical spring shown in FIG. 3.
Figure 3:
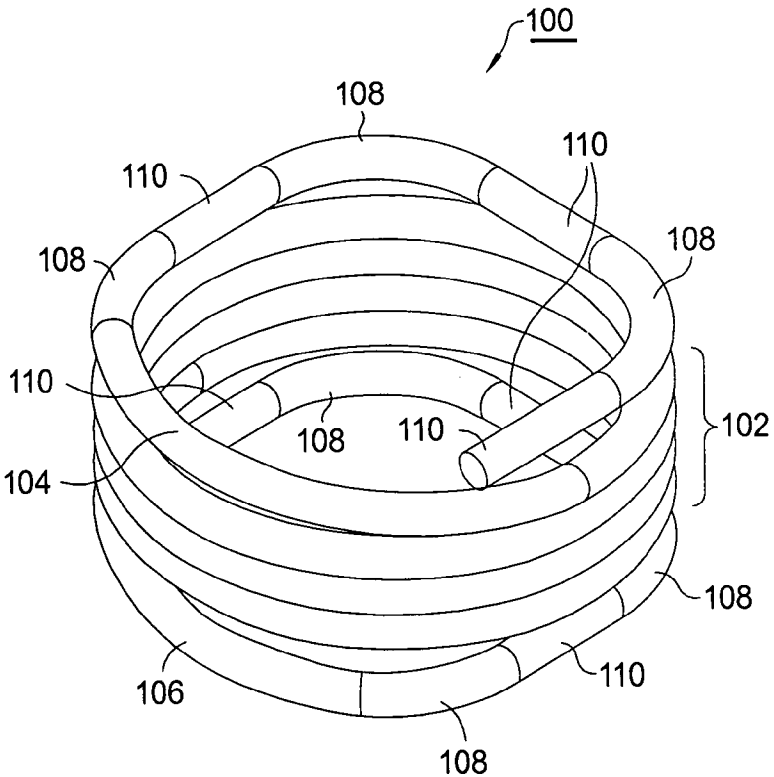
FIG. 3 is an isometric view of a three-flat helical phaser spring in accordance with the invention.

Referring to FIGS. 3 and 4, a first embodiment 100 is shown of a phaser bias spring in accordance with the present invention. Spring 100 comprises a plurality of circular coils 102 all having a first radius. At least one of end coils 104, 106 has regions 108 of radius lesser than the first radius, as well as a plurality of linear (flat) regions 110. (Note that a helical bias spring having flats at one end and a radial or axial tang at the other end is fully comprehended by the present invention.)

Figure 6:
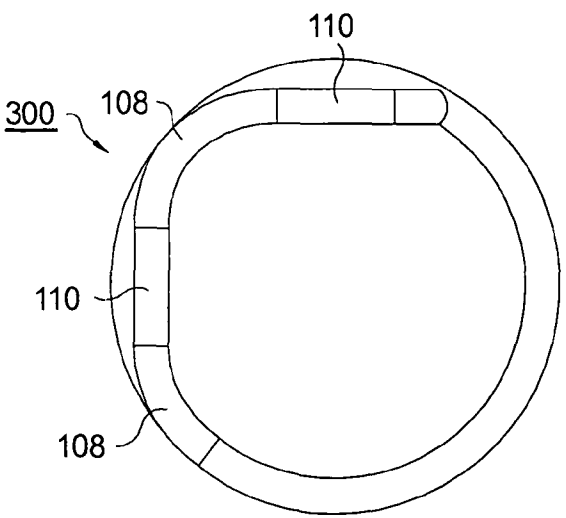
FIG. 6 is a plan view of a two-flat helical spring in accordance with the present invention.
Figure 7:
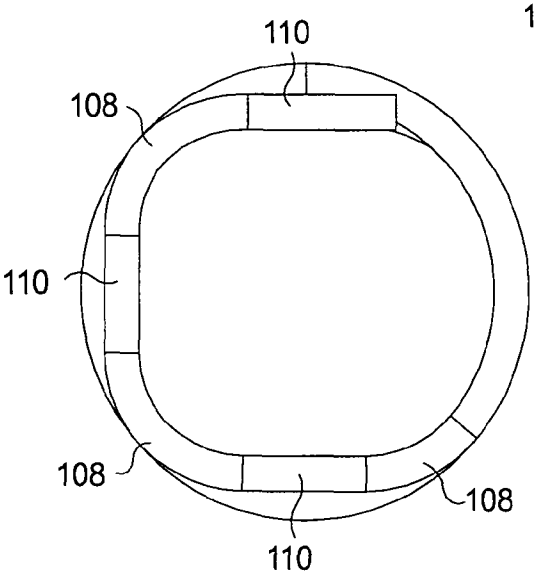
FIG. 7 is a plan view of a three-flat helical spring in accordance with the present invention.
Figure 5:
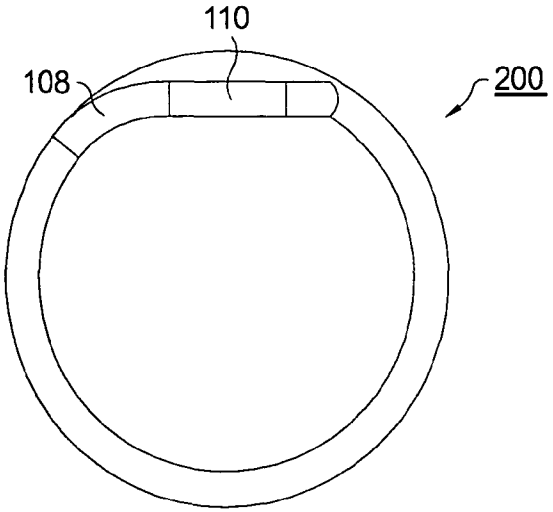
FIG. 5 is a plan view of a one-flat helical spring in accordance with the present invention.

Referring to FIGS. 5 through 7, additional embodiments in accordance with the present invention are possible. For example, a spring 200 (FIG. 5) may have as few as one region 108 and one region 110; or only two regions 108 and two regions 110 (spring 300, FIG. 6). Note that the spring shown in FIG. 7, having three regions 108 interspersed with three regions 110 is identical with spring 100 shown in FIGS. 3 and 4. Note further that springs 100,300 employ a rectilinear geometry defined herein as being "square-end". Other geometric shapes having short-radius curves 108 and flats 110 are possible within the scope of the invention, for example, triangular, pentagonal, hexagonal, and the like; however, square-end is currently preferred, as is a round, square or rectangular cross-section spring wire stock.

There are three considerations addressed by a non-tang spring end: improved durability, improved packaging (minimal axial or radial space required), and improved performance.

A non-tang spring end presents a more distributed loading to the interfacing components. By applying the load to a larger area (across two or preferably three flats 110) and by fixing the last coil 104 and/or 106, wear rates of the bias spring interface to the rotor or stator decrease significantly.

A non-tang spring end minimizes packaging size and reduces complexity of interfacing components. Prior art helical bias springs employ axial, radial, and/or tangential tangs to ground the ends of a helical bias spring to the interfacing components. Each of these tangs increases overall package size in its respective direction, whereas a square-end spring incurs little or no increase in package size in any of those directions.

A non-tang spring end improves phaser performance by decreasing frictional hysteresis. In any bias spring, there are six vectors along which energy can be entered into the system via the spring (translational and rotational vectors about three orthogonal axes). A typical torsion spring produces excessive unwanted energy in more than one of the five undesired directions. A non-tang, square-end bias spring produces a more 'pure' moment (in the desired direction) than does a tang-end bias spring by being less prone to axial and radial force loading ("cocking") of a phaser rotor and stator.

Figure 9:
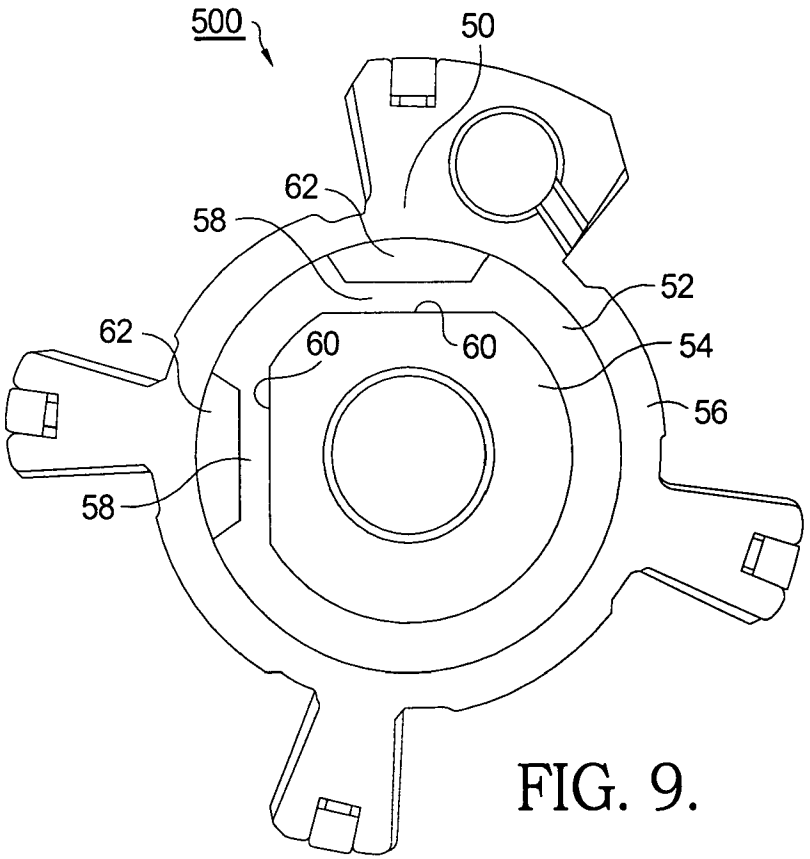
FIG. 9 is a view of the underside of a two-flat phaser rotor for receiving the two-flat helical spring shown in FIG. 6.
Figure 8:
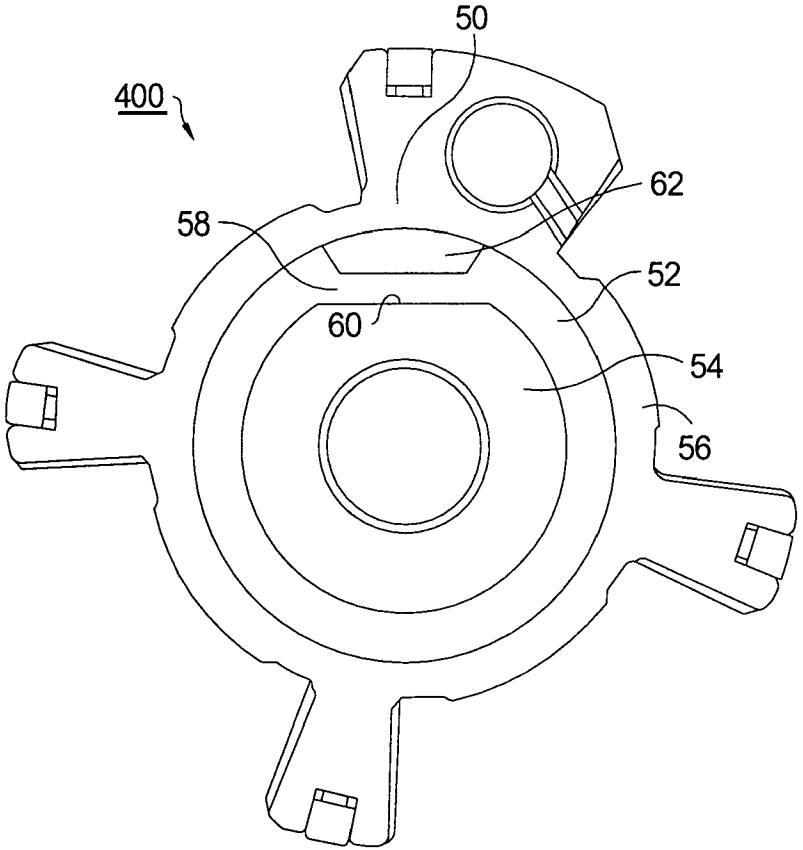
FIG. 8 is a view of the underside of a one-flat phaser rotor for receiving the one-flat helical spring shown in FIG. 5.
Figure 10:
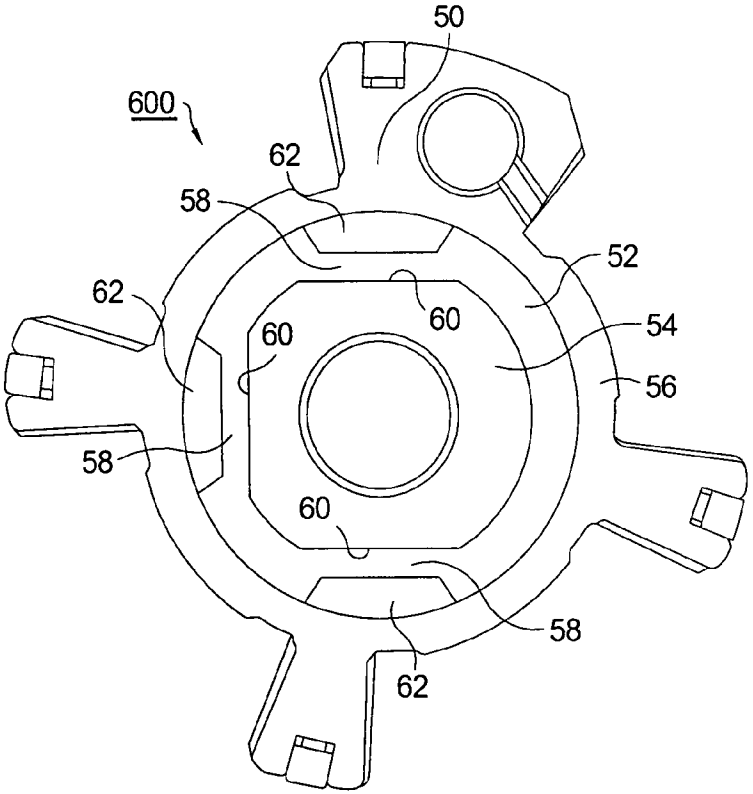
FIG. 10 is a view of the underside of a three-flat phaser rotor for receiving the three-flat helical spring shown in FIG. 7.

Referring to FIGS. 8 through 10, three exemplary phaser rotors 400,500,600 in accordance with the present invention are shown for receiving springs 200,300, 100, respectively. The face 50 of each rotor is formed having a partially-circular channel 52, defining a hub portion 54 and a peripheral portion 56 of face 50, for receiving the end coil 104 or 106 (FIG. 3) of the respective spring. Each channel 52 includes a non-circular portion 58 defined by a hub flat 60 and opposing peripheral land 62 for receiving a corresponding spring flat 110. Channels 52 are formed with minimal clearance between the spring flats 110 and the hub flats 60 and lands 62 to firmly anchor the spring.

Figure 11:
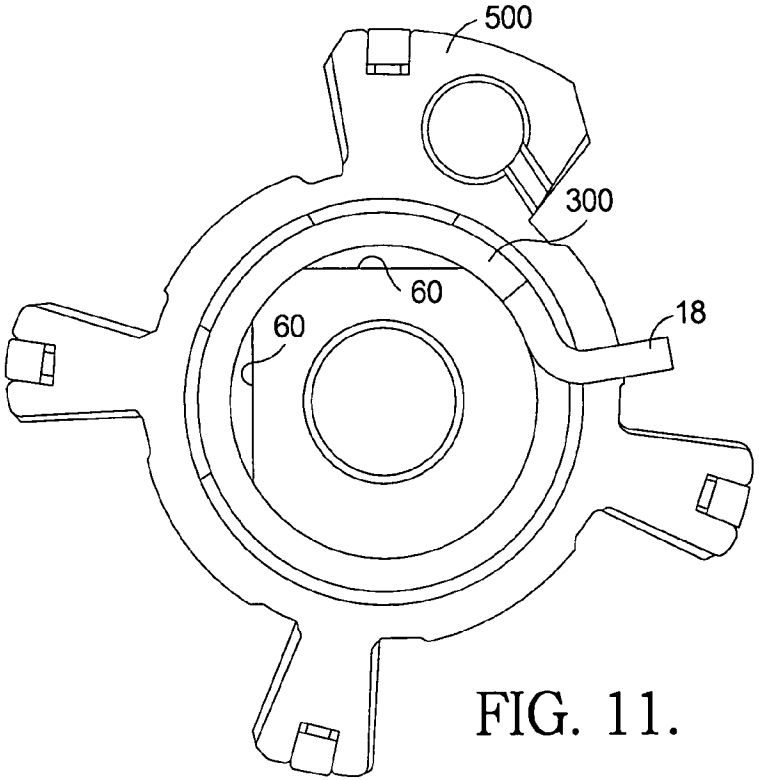
FIG. 11 is a view showing the two-flat helical spring shown in FIG. 6 installed in the two-flat phaser rotor shown in FIG. 9.

FIG. 11 shows a version of square-end spring 300 installed into rotor 500, spring 300 having a prior art radial end tang 18 for grounding to an anchor in a phaser stator (not shown).

A radial tang is often still the best option for grounding to a front cover (stator), while a square end generally is best for grounding to a rotor as shown in FIGS. 8 through 11. However, one application where double square ends have significant advantages for the cover packaging is in a sealed pulley application.

Figure 12:
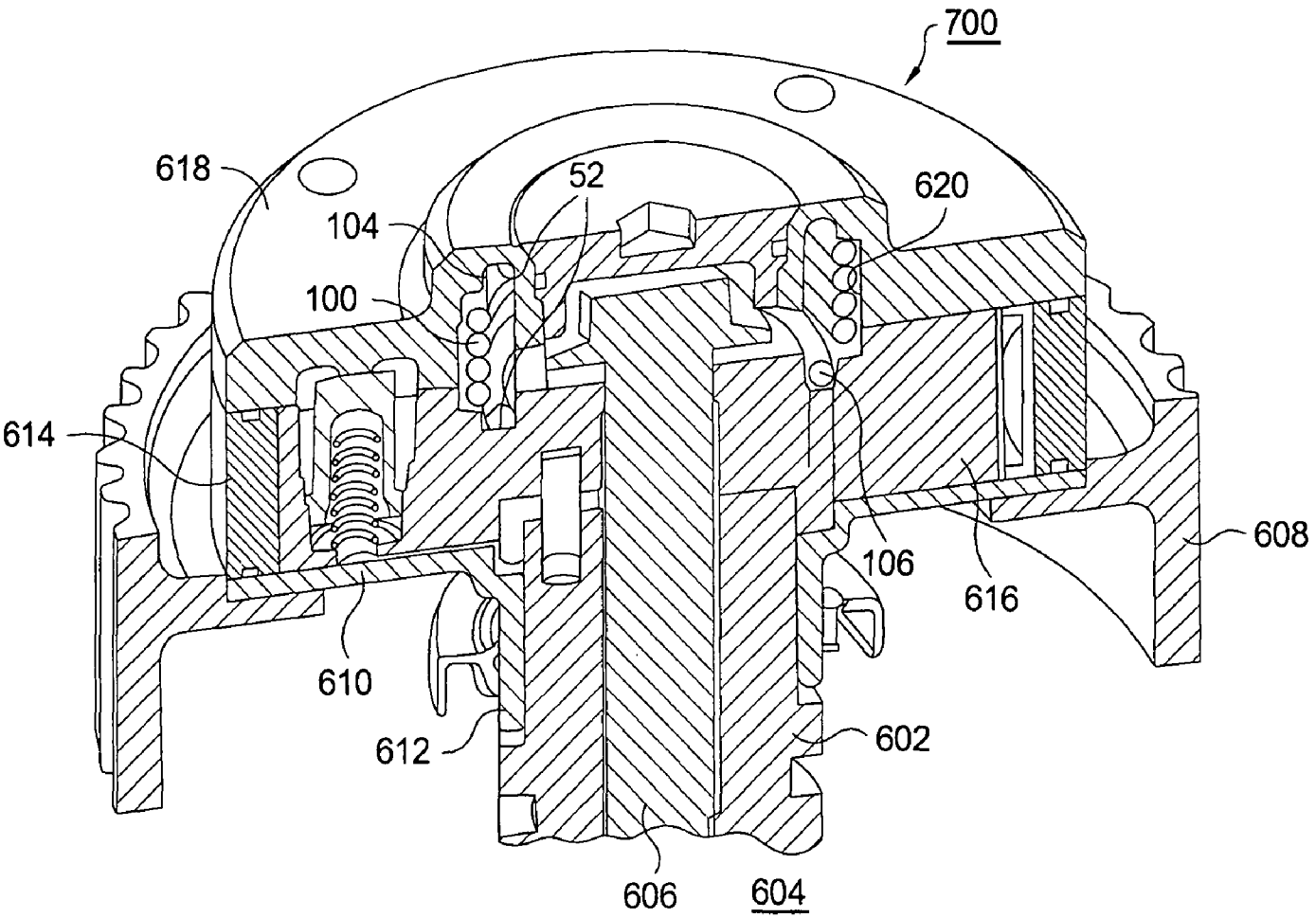
FIG. 12 is a cutaway isometric view of a complete camshaft phaser including a helical bias spring in accordance with the present invention.

Referring to FIG. 12, a complete sealed phaser assembly 700 is shown mounted on the end of a camshaft 602 of an internal combustion engine 604 by through bolt 606. Phaser assembly 700 comprises a toothed pulley 608 driven by a toothed timing belt (not shown). Such timing belts typically are run in a non-lubricated (dry) environment; hence, phaser assembly 700 must be sealed and have an oil return path so that actuation oil cannot leak onto the timing belt. Phaser assembly 700 includes a stator faceplate 610 having a boss 612 mounted on camshaft 602. Stator 614 is mounted on faceplate 610. Rotor 616 is provided within stator 614. Cover plate 618 is mounted and fixed on stator 614, enclosing rotor 616. A first channel 52 is formed in rotor 614, and a second channel 52 is formed in cover plate 618. A helical bias spring 100 in accordance with the present invention is disposed in a well 620 formed in cover plate 618, and first and second square-ends 104,106 are disposed in the respective channels 52.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A camshaft phaser comprising:

a) a stator;

b) a rotor disposed within said stator;

c) a cover plate attached to said stator to close a chamber containing said rotor; and d) a helical bias spring grounded at a first end to said rotor and grounded at a second end to one of said stator and said cover plate, and having a helical radius of curvature, wherein at least one of said first and second ends includes at least two linear regions and an adjacent region between each of said at least two linear regions having a radius of curvature less than said helical radius of curvature.

2. A camshaft phaser in accordance with claim 1 wherein both of said first and second ends includes at least two linear regions and an adjacent region between each of said at least two linear regions having a radius of curvature less than said helical radius of curvature.

3. A camshaft phaser in accordance with claim 1 wherein said cover plate includes a channel formed for receiving said at least one of said first and second ends.

4. A camshaft phaser in accordance with claim 1 wherein spring stock forming said helical bias spring has a cross-sectional shape selected from the group consisting of rectangular, round and square.

5. An internal combustion engine comprising a camshaft phaser disposed on a camshaft thereof, wherein said camshaft phaser includes a stator, a rotor disposed within said stator, a cover plate attached to said stator to close a chamber containing said rotor, and a helical bias spring grounded at a first end to said rotor and grounded at a second end to one of said stator and said cover plate, and having a helical radius of curvature, wherein at least one of said first and second ends includes at least two linear regions and an adjacent region between each of said at least two linear regions having a radius of curvature less than said helical radius of curvature.

* * * * *